US009091148B2

(12) United States Patent
Moffitt et al.

(10) Patent No.: US 9,091,148 B2
(45) Date of Patent: Jul. 28, 2015

(54) APPARATUS AND METHOD FOR CEMENTING LINER

(75) Inventors: Michael E. Moffitt, Houston, TX (US); Erik P. Eriksen, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 588 days.

(21) Appl. No.: 13/032,802

(22) Filed: Feb. 23, 2011

(65) Prior Publication Data

US 2011/0203794 A1 Aug. 25, 2011

Related U.S. Application Data

(60) Provisional application No. 61/307,238, filed on Feb. 23, 2010.

(51) Int. Cl.

| | |
|---|---|
| ***E21B 34/06*** | (2006.01) |
| ***E21B 43/10*** | (2006.01) |
| ***E21B 7/20*** | (2006.01) |
| ***E21B 33/13*** | (2006.01) |

(52) U.S. Cl.
CPC . *E21B 43/10* (2013.01); *E21B 7/20* (2013.01); *E21B 33/13* (2013.01)

(58) Field of Classification Search
CPC ..... E21B 33/13; E21B 43/10; E21B 7/20
USPC ..... 166/285, 382, 332.8, 373, 290, 325; 137/522
See application file for complete search history.

(56) References Cited

U.S. PATENT DOCUMENTS

| | | | | |
|---|---|---|---|---|
| 2,942,665 | A * | 6/1960 | Davis et al. | 166/124 |
| 3,163,238 | A | 12/1964 | Malott | |
| 4,848,459 | A | 7/1989 | Blackwell et al. | |
| 5,074,366 | A | 12/1991 | Karlsson et al. | |

(Continued)

FOREIGN PATENT DOCUMENTS

| | | |
|---|---|---|
| CA | 2311160 A1 | 12/2001 |
| CA | 2538196 | 8/2006 |

(Continued)

OTHER PUBLICATIONS

Weatherford "R Running Tool with Hydraulically Released Mechanical Lock", 2006, pp. 1-2.

(Continued)

*Primary Examiner* — David Andrews
*Assistant Examiner* — Taras P Bemko
(74) *Attorney, Agent, or Firm* — Osha Liang LLP

(57) ABSTRACT

A method of cementing a liner in a well includes mounting a valve assembly that is biased in a closed position to a running tool assembly. The running tool assembly has a stinger inserted through the valve assembly, retaining the valve assembly in an open position. The stinger has a cement retainer releasably mounted to it. After lowering the running tool assembly into engagement with the liner string, the operator pumps a cement slurry through the stinger and the valve assembly. The operator then pumps the cement retainer down the liner string into latching engagement with a lower portion of the liner string. Afterward, the operator lifts the stinger from the valve assembly, causing the valve assembly to move to the closed position. The valve assembly blocks upward flow of fluid from the well conduit through the valve assembly in the event of leakage of the cement retainer.

6 Claims, 8 Drawing Sheets

(56) References Cited

U.S. PATENT DOCUMENTS

| | | | | |
|---|---|---|---|---|
| 5,425,423 | A | 6/1995 | Dobson et al. | |
| 5,823,265 | A | 10/1998 | Crow et al. | |
| 5,957,225 | A | 9/1999 | Sinor | |
| 6,095,261 | A | 8/2000 | Trevino, Jr. | |
| 6,138,774 | A | 10/2000 | Bourgoyne, Jr. et al. | |
| 6,343,658 | B2 * | 2/2002 | Webb | 166/386 |
| 6,401,824 | B1 | 6/2002 | Musselwhite et al. | |
| 6,412,574 | B1 | 7/2002 | Wardley et al. | |
| 6,543,552 | B1 | 4/2003 | Metcalfe et al. | |
| 6,739,398 | B1 | 5/2004 | Yokley et al. | |
| 6,742,606 | B2 | 6/2004 | Metcalfe et al. | |
| 6,854,533 | B2 | 2/2005 | Galloway et al. | |
| 6,857,487 | B2 | 2/2005 | Galloway et al. | |
| 6,899,186 | B2 | 5/2005 | Galloway et al. | |
| 7,013,997 | B2 | 3/2006 | Vail, III | |
| 7,036,610 | B1 | 5/2006 | Vail, III | |
| 7,040,420 | B2 | 5/2006 | Vail, III | |
| 7,048,050 | B2 | 5/2006 | Vail, III et al. | |
| 7,083,005 | B2 | 8/2006 | Galloway et al. | |
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,084 | B2 | 9/2006 | Vail, III | |
| 7,117,957 | B2 | 10/2006 | Metcalfe et al. | |
| 7,147,068 | B2 | 12/2006 | Vail, III | |
| 7,165,634 | B2 | 1/2007 | Vail, III | |
| 7,225,880 | B2 | 6/2007 | Braddick | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 7,360,594 | B2 | 4/2008 | Giroux et al. | |
| 7,647,990 | B2 | 1/2010 | Tessari et al. | |
| 7,784,552 | B2 | 8/2010 | Brouse | |
| 7,926,590 | B2 | 4/2011 | Eriksen et al. | |
| 2001/0017210 | A1 | 8/2001 | Howlett | |
| 2003/0173091 | A1 * | 9/2003 | Horne et al. | 166/386 |
| 2004/0221997 | A1 | 11/2004 | Giroux et al. | |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0175665 | A1 | 8/2007 | Tessari et al. | |
| 2007/0267221 | A1 | 11/2007 | Giroux et al. | |
| 2009/0090508 | A1 | 4/2009 | Brouse | |
| 2009/0101345 | A1 | 4/2009 | Moffitt et al. | |
| 2009/0107675 | A1 | 4/2009 | Eriksen et al. | |
| 2009/0272544 | A1 * | 11/2009 | Giroux et al. | 166/382 |
| 2010/0126734 | A1 | 5/2010 | Eriksen | |
| 2010/0282463 | A1 | 11/2010 | Boyle | |

FOREIGN PATENT DOCUMENTS

| | | | |
|---|---|---|---|
| WO | WO2004/053288 | A1 | 6/2004 |
| WO | WO2007/011906 | A1 | 1/2007 |

OTHER PUBLICATIONS

Drilling Contractor "Liner Drilling Technology Being Prepared for Offshore", Jan./Feb. 2004, pp. 14-15.

Dril-Quip LS-15 Liner Hanger System, Sales Manual, pp. 5-7.

TIW "Liner Equipment"HLX Liner-Top Packer, pp. 5, 9-11, 18-19.

Dril-Quip "LS-15 Liner Hanger System", pp. 1-2, 4 and 6.

Drilling Liner Technology for Depleted Reservoir, C. Vogt, SPE and F. Makohl, SPE, Baker Hughes INTEQ; P. Suwarno, SPE and B. Quitzau, SPE, Mobil Oil Indonesia—SPE 36827—pp. 127-132.

Simultaneous Drill and Case Technology—Case Histories, Status and Options for Further Development br Detlef Hahn, Baker Hughes Inteq, Wilhelmus Van Gestel, BP Amoco Norway AS, Norbert Frohlich, Baker Hughes Inteq, Glenn Stewart, Baker Hughes Inteq—SPE International, IADC/SPE 59126, Feb. 23-25, 2000, pp. 1-9.

World Oil/Oct. 1999—Drilling Technology "Casing-While-Drilling: The Next Step Change in Well Construction", pp. 34-36 and 38-40.

Rotary Steerable Drilling with Liner—during 2007 or later based on the text—Randi Elisabeth Hugdahl, Leader, TNE RD RCT DWPT—pp. 3-5.

Office Action in counterpart Mexican Patent Application No. MX/a/2012/009777 with English correspondence, mailed Aug. 21, 2014 (5 pages).

Office Action in counterpart Mexican Patent Application No. MX/a/2012/009777 with English correspondence, mailed Jan. 23, 2015 (10 pages).

* cited by examiner

APPARATUS AND METHOD FOR CEMENTING LINER

CROSS-REFERENCE TO RELATED APPLICATION

This application claims priority to provisional patent application 61/307,238, filed Feb. 23, 2010.

FIELD OF THE DISCLOSURE

This disclosure relates in general to equipment and methods for cementing liner strings within a wellbore, and particularly to equipment that is utilized when the liner string serves as the drill string.

BACKGROUND

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper retainer following the cement to wipe cement from the interior of the liner at the conclusion of the cement pumping. The operator then sets the liner top packer, if used, releases the running tool from the liner, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. This method is similar to a related technology known as casing drilling. One technique employs a drill bit on the lower end of the liner. One option is to not retrieve the dell bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits.

Published application US 2009/0107,675, discloses a system for retrieving the bottom hole assembly by setting the liner hanger before cementing the liner. If the liner is at the total depth desired after retrieving the bottom hole assembly, the operator then runs a cementing assembly on a running tool back into engagement with the liner hanger. The cementing assembly includes a tieback assembly that stabs into sealing engagement with an upper portion of the liner string. A packer may also be included with the cementing assembly for sealing an annulus surrounding the liner. In addition, a cement retainer carried by the cementing assembly is pumped down to a lower end of the liner and latched after cementing. The cement retainer prevents backflow of cement.

SUMMARY

In the method disclosed herein, a valve assembly that is biased to a closed position is attached to a running tool assembly. A downward extending stinger of the running tool assembly extends through the valve assembly, holding the valve assembly in the open position. The running tool assembly and the valve assembly are placed into engagement with well conduit. The operator then performs one or more operations on the well conduit with the running tool assembly, including pumping a fluid through the stinger and the valve assembly while the valve assembly is in the open position. The operator then lifts the stinger from the valve assembly, causing the valve assembly to move to the closed position. The operator retrieves the running tool assembly from the conduit, leaving the valve assembly in engagement with the well conduit.

While in the closed position after the stinger is lifted, the valve assembly blocks upward flow of a fluid from below the valve assembly. In one embodiment, the valve assembly also blocks downward flow of a fluid from above the valve assembly.

In one method, the operation performed while the valve assembly is open includes pumping a cement slurry down the well conduit and back up an annulus surrounding the well conduit to cement the well conduit within a borehole. The operator may also pump a cement retainer from the running tool assembly down the well conduit into latching engagement with the well conduit near a bottom of the well conduit. The cement retainer prevents the cement slurry from flowing down the annulus and up the well conduit. After the cement retainer has latched, lifting the stinger closes the valve assembly. The closure of the valve assembly prevents the cement slurry from flowing down the annulus and up the well conduit in the event of failure of the cement retainer.

After lifting the stinger, the operator may circulate a cleaning liquid through the stinger while the valve assembly is in the closed position. The valve assembly blocks downward flow of the liquid past the valve assembly into the well conduit.

The operator may also mount a tieback assembly to the running tool assembly and secure the valve assembly to the tieback assembly. When lowering the running tool assembly into the well, the operator stabs the tieback assembly sealingly into the well conduit. Normally, the tieback assembly includes a packer. After cementing, the operator sets the packer above the cement slurry and within the annulus surrounding the well conduit.

In one embodiment, the valve assembly includes a tubular housing having an axis. A pair of valve seats is mounted within the housing in axial alignment with each other. A flapper valve element is secured bra hinge to each of the seats for pivotal movement between open and closed positions. Each of the flapper valve elements is biased to the closed position in contact with one of the seats. One of the valve elements pivots in a first direction when moving from the closed to the open position. The other of the valve elements pivots in a second direction when moving from the closed position, such that when, both are in the closed position, fluid flow through the housing is prevented in both directions.

Preferably, an annular seal interface is located axially between the valve elements for sealingly engaging a tubular stinger inserted through the seats while the valve elements are in the open position. The seats may be on opposite ends of a tubular body having an outer diameter scaled to an inner diameter of the housing. The annular seal interface may be located in a bore of the body axially between the seats.

DETAILED DESCRIPTION

Figure 1A:
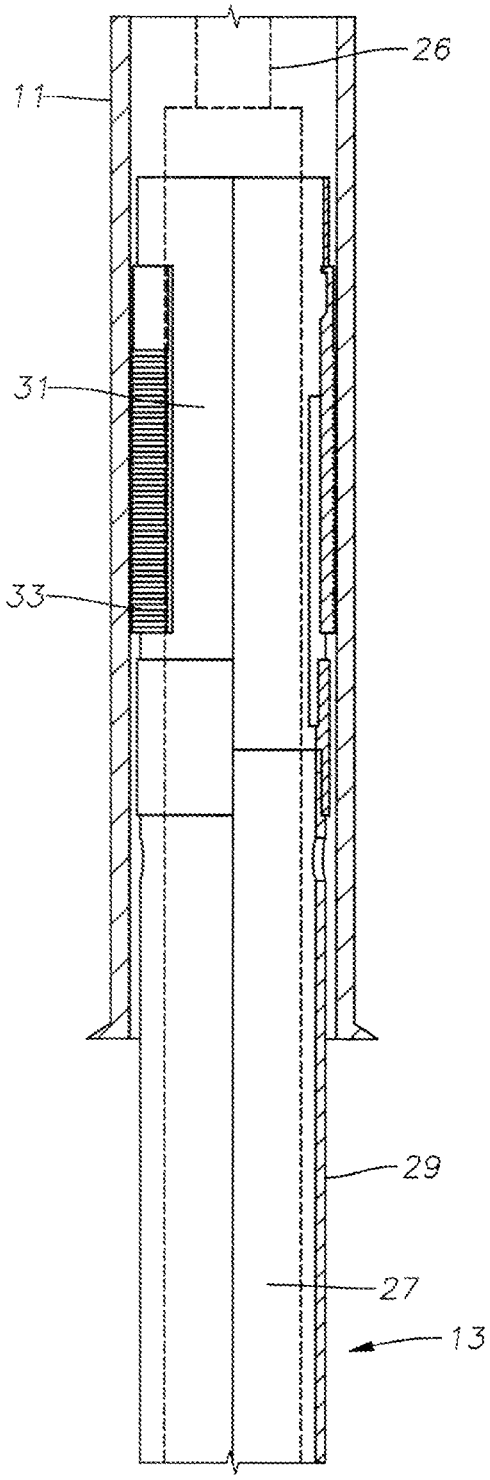
FIGS. 1A-1C comprise a half-sectional view of a liner string having a bottom hole assembly installed for drilling with the liner string.
Figure 1B:
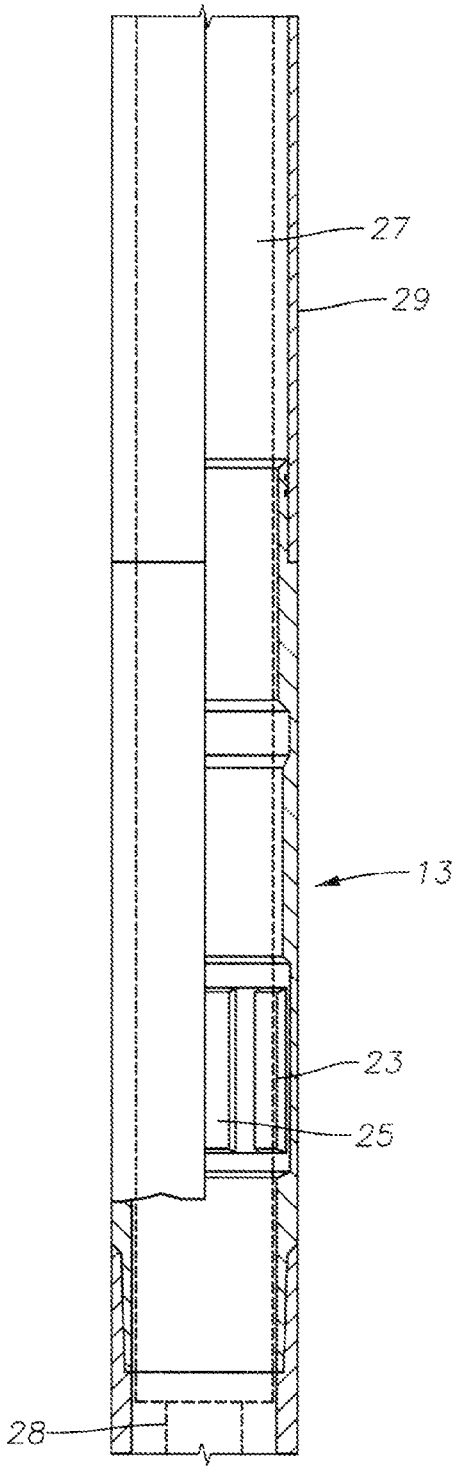
Figure 1C:
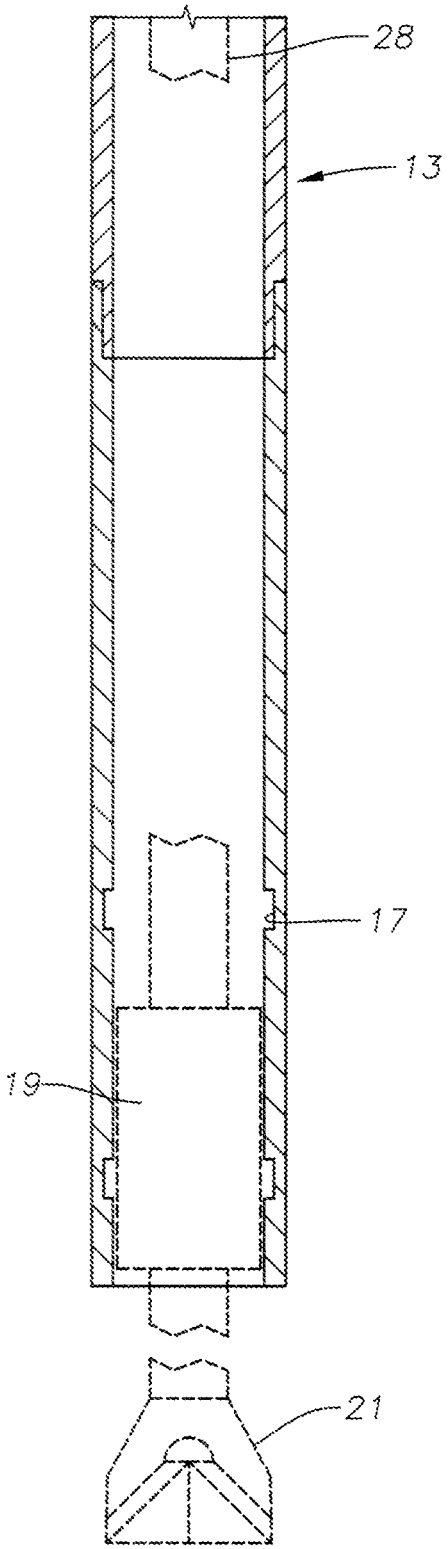

Referring to FIGS. 1A and 1C, a string of casing 11 has been previously installed and cemented in the wellbore. A liner string 13 extends down from casing string 11 to the total depth of the wellbore, but has not yet been cemented in place. The term "liner string" refers to a string of well pipe that does not extend all the way up to the wellhead; rather it will eventually be cemented in the wellbore with its upper end a short distance above the lower end of casing string 13. The terms "casing" and "liner" may be used interchangeably. In this embodiment, liner string 13 will normally have been deployed by drilling the wellbore at the same time the liner string 13 is being lowered into the well.

Referring to FIG. 1C, a cementing retainer profile 17, such as an annular recess, is also located near the lower end of casing string 13. During liner drilling, a bottom hole assembly (BHA) 19 extends from the lower end of liner string 13. BHA 19 is shown in dotted lines because it will be retrieved in this example before the cementing occurs. BHA 19 includes a drill bit 21 and normally additional equipment, such as an underreamer and optionally surveying instruments and directional drilling equipment.

Liner string 13 also includes a torque or profile sub 23 (FIG. 1B), which is near the upper end of liner string 13 in this embodiment. Torque sub 23 has an internal profile 25, such as vertical splines. A liner running tool 27 releasably secures an upper section of a work string, such as drill pipe 26 (FIG. 1A), to torque sub 23 of liner string 13 for transmitting torque to liner string 13 and supporting the weight of liner string 13. A lower drill pipe section 28 (FIG. 1C) extends downward from torque sub 23 through liner string 13 and is secured to BHA 19. Rotating drill pipe 26 (FIG. 1A) by a drilling rig (not shown) will cause lower drill pipe section 28 to rotate BHA 19, applying drilling torque to drill bit 21. Torque sub 23 also causes liner running tool 27 to rotate, which in turn rotates torque sub 23 because of its engagement with profile 25. This results in the entire liner string 13 and BHA 19 rotating. Drilling fluid is pumped down upper drill pipe string 26, lower drill pipe string 28 and out bit 21 of BHA 19. Published application US 2009/0107675 describes more details of the liner drilling system illustrated in FIGS. 1A-1C. Other systems for drilling with liner string 13 are feasible, including having the torque sub located near the lower end of liner string 13 rather than at the upper end as shown in FIG. 1B.

Referring to FIG. 1B, liner string 13 also includes a lower polished bore receptacle 29 located above torque sub 23. Lower polished bore receptacle 29 is a cylindrical member having a smooth bore for sealing purposes. A liner hanger 31 (FIG. 1A) mounts to the upper end of lower polished bore receptacle 29. Liner hanger 31 will be placed in a set position before removing drill pipe strings 26, 28, running tool 27 and BHA 19. Liner hanger 31 may be a type that can be reset in order to retrieve BHA 19 for repair or replacement. If resettable, the operator can run BHA 19 back, re-engage running tool 27 with torque sub 23 and release liner hanger 31 to continue drilling. Alternately, liner hanger 31 may be a type that is set only once and remains set. Liner hanger 31 has slips 33 that grip the inner diameter of casing string 11 and support the weight of liner string 13 when set. At the completion of drilling, liner hanger 31 will be set near but above the lower end of casing string 11.

Figure 2A:
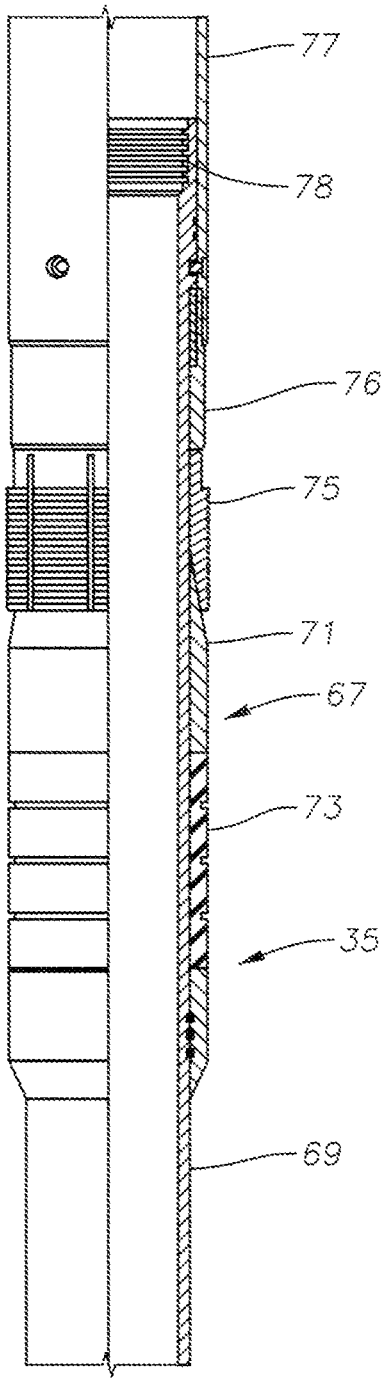
FIGS. 2A-2C comprise a half-sectional view of a packer and cementing assembly for installation with the liner string after the bottom hole assembly is retrieved.
Figure 2B:
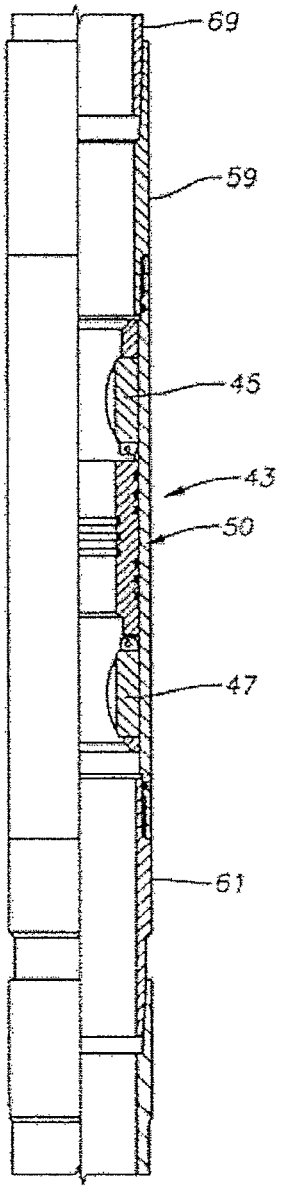
Figure 2C:
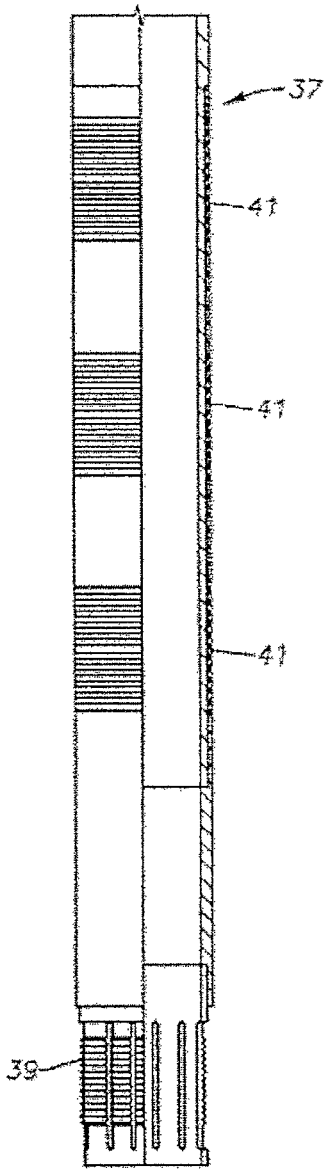
Figure 4A:
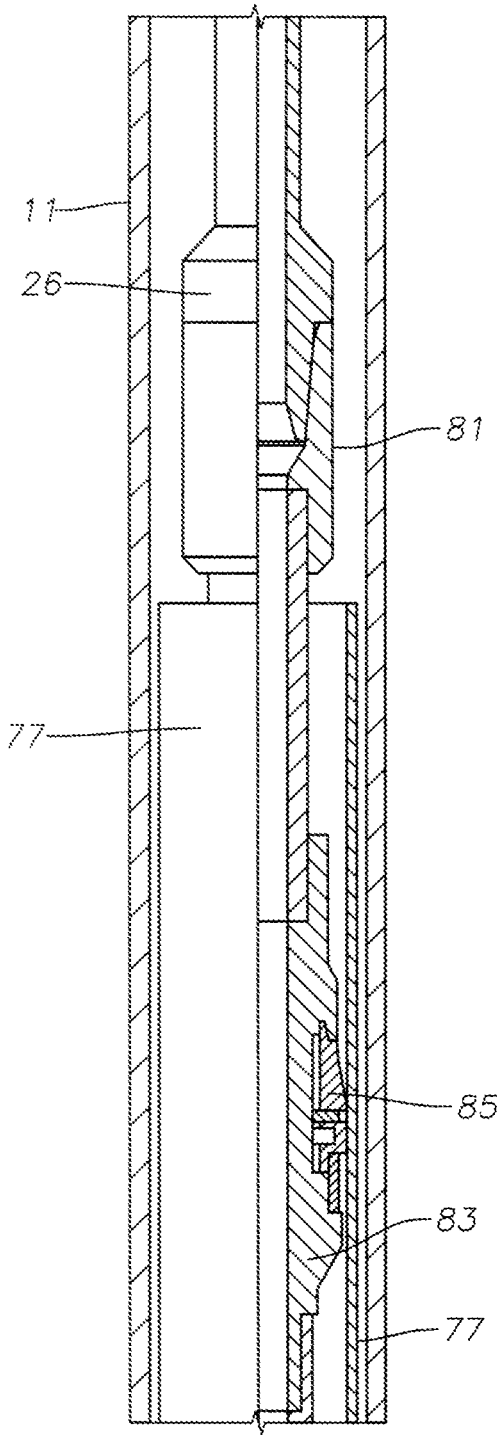
FIGS. 4A-4F comprise a half-sectional view of the running tool assembly of FIGS. 3A-3B positioned within the packer and cementing assembly of FIGS. 2A-2C and the packer and cementing assembly inserted into an upper end of the liner string.

Once the well has been drilled to total depth and BHA 19 and running tool 27 are retrieved, liner string 13 will be in condition for cementing. Referring to FIGS. 2A-2C, a packer and cementing assembly 35 will be lowered into engagement with liner hanger 31, lower polished bore receptacle 29 and the upper portion of torque sub 23. FIGS. 2A-2C illustrate packer and cementing assembly 35 as it would appear prior to lowering into casing 11. Packer and cementing assembly 35 includes on its lower end a tieback seal nipple 37, as shown in FIG. 2C. Tieback seal nipple 37 is a tubular member having seals 41 located on its outer diameter. Seals 41 are adapted to sealingly engage the inner diameter of lower polished bore receptacle 29 (FIG. 1B). Tieback seal nipple 37 has an optional latch 39 on its lower end with gripping members that will engage a grooved profile in the upper end of torque sub 23, as shown in FIG. 4D.

Figure 5:
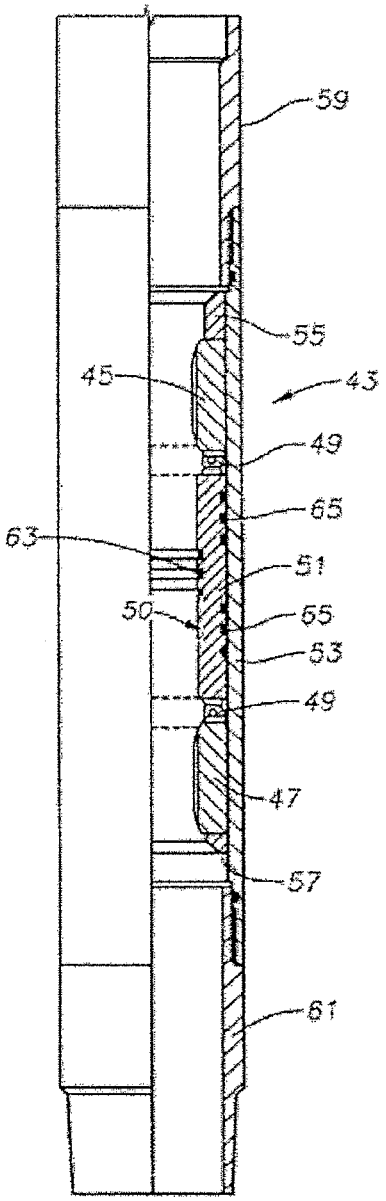
FIG. 5 is a half-sectional view of the valve assembly carried by the running tool assembly in FIGS. 3A-3B and 4A-4F.

Referring to FIG. 2B, a valve assembly 43 connects to the upper end of tieback seal nipple 37 in this example. Valve assembly 43 comprises a mechanism that has an open position and a closed position. In the closed position, valve assembly 43 seals against pressure from below and optionally against pressure from above. In the open position, valve assembly 43 may allow fluid to flow through in both directions. In this example, valve assembly 43 comprises an upper flapper valve element 45 and a lower flapper valve element 47, each of which will pivot between an open position shown in FIG. 2B and a closed position, shown by dotted lines in FIG. 5. Referring to FIG. 5, each flapper element 45 and 47 is connected by a hinge 49 to a valve seat 50. Although the valve seats 50 could be separate elements, in this example, one valve seat 50 comprises an upper end portion of a tubular central body 51. The other valve seat 50 comprises a lower end portion of body 51. Also, in this example, the upper seat 50 faces upward and the lower seat 50 faces downward. When in the closed position, as shown by the dotted lines, upper flapper 45 will seal against the upward facing seat 50, and lower flapper 47 will seal against the downward facing seat 50. When moving from the closed to the open position, one of the flappers 45 will pivot in one direction and the other in an opposite direction. For example, upper flapper 45 pivots upward when opening and lower flapper 47 pivots downward while opening. Upper and lower flappers 45 and 47 are biased by conventional springs (not shown) to the closed position.

The positions of flappers 45, 47 may be reversed; flapper 47 may be biased to seal pressure from above and flapper 45 from below. In that instance flapper 47 would pivot upward to open and flapper 45 would pivot downward to open. Hinges 49 are shown to be on the same side of central body 51, which is the right side as shown in FIG. 5. Alternately, hinges 49 could be on different sides of central body 51.

Central body 51 is secured within the bore of a tubular housing 53 with its outer diameter in sealing engagement with the bore of tubular housing 53. Central body 51 preferably is rigidly attached to tubular housing 53 and may be secured within tubular housing 53 in various manners, including retainer rings, press-fitting or welding. Flappers 45 and 47 can be held in the open position by a central tubular member that will be subsequently explained. The bore of central body 51 has a seal interface for sealing against the tubular member. In this embodiment, the seal interface comprises seals 63 mounted in annular grooves in the bore of central body 51. Valve assembly 43 is formed of a drillable material, such as aluminium. Rather than flapper valve elements, another assembly that would work for the same purpose would include upper and lower ball valves. Central body 51 includes an upper adapter 59 on its upper end and a lower adapter 61 on its lower end. Referring back to FIG. 2B, adapters 59, 61 have threads that attach housing 53 into packer and cementing assembly 35 (FIG. 2A).

Still referring to FIG. 2A, a liner top packer 67 secures to the upper end of top adapter 59. Liner top packer 67 may be a conventional packer for sealing between liner string 13 and the inner diameter of casing 11 (FIG. 1A). In this example, liner top packer 67 is set by weight although it could be rotationally or hydraulically set. Liner top packer 67 has a body 69 that is tubular and has a conical upper end 71. Elastomeric packer elements 73 are located around body 69. A set of slips 75 is positioned on conical upper end 71. An inner tubular body of liner top packer 67 has an interior set of left-hand threads 78, but other attachment devices besides left-hand threads are feasible. A setting sleeve 76 surrounds the inner tubular body and engages the upper end of slips 75. Packer 67 is shown in the unset position in FIG. 2A. To set, a downward force on setting sleeve 76 will cause slips 75 to be expanded over conical surface 71 and will also deform packer elements 73 radially outward. Slips 75 will engage the inner diameter of casing 11 (FIG. 1A) to hold liner top packer 67 in the set position.

An optional upper polished bore receptacle 77 may be mounted to the upper end of setting sleeve 76. Upper polished bore receptacle 77 is utilized for sealing purposes in case of problems in sealing tieback seal nipple 37 (FIG. 2C) to lower polished bore receptacle 29 (FIG. 1A) if another packer is required for sealing to casing string 11. Prior to cementing, packer and liner top assembly 35 of FIGS. 2A-2C will be lowered into engagement with torque sub 23, lower polished bore receptacle 29 and liner hanger 31, as shown in FIGS. 1A and 1B. Packer and liner top assembly 35 will remain in the wellbore after cementing.

Figure 3A:
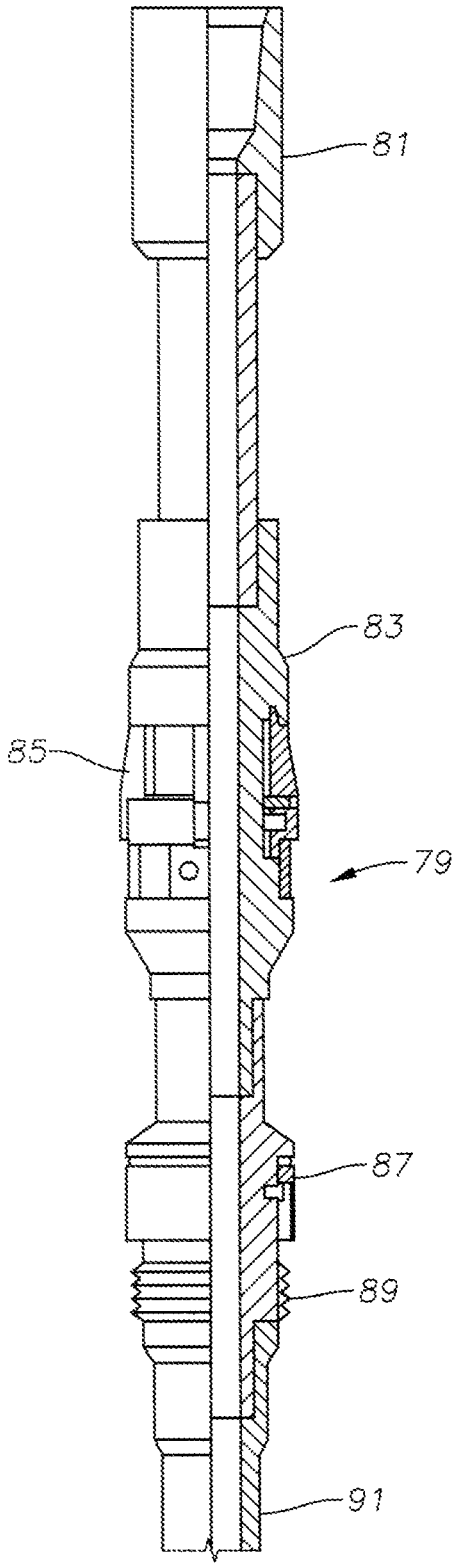
FIGS. 3A-3B comprise a half-sectional view of a running tool assembly for running the packer and cementing assembly of FIGS. 2A-2C.
Figure 3B:
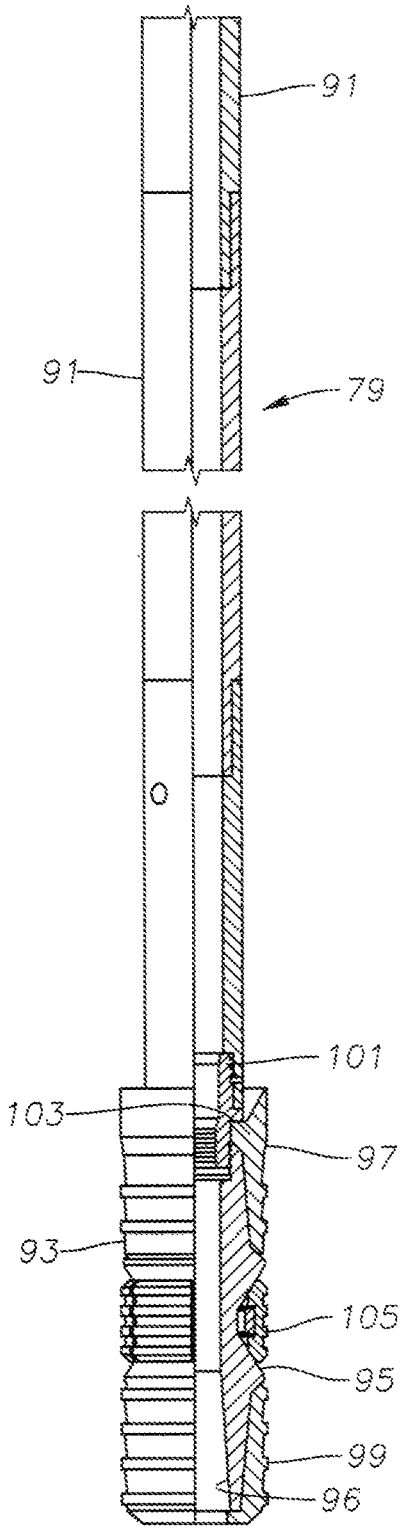

FIGS. 3A and 3B illustrate a running tool assembly 79, most of which will be retrieved after cementing. Running tool assembly 79 includes an adapter 81 at the upper end for securing it to a work string such as a string of drill pipe. Running tool assembly 79 includes a packer setting tool 83, which secures to the lower end of adapter 81. Packer setting tool 83 is a type utilized for setting packer 67 (FIG. 2A). In this example, packer setting tool 83 is a mechanical type tool that sets in response to rotation and weight imposed by the running string. Alternately, it could be a hydraulically actuated tool. Packer setting tool 83 has a set of spring-biased dogs 85 that are biased radially outward. When running tool assembly 79 is inserted into packer and cementing assembly 35, dogs 85 will be located within upper polished bore receptacle 77 and urged outward against the sidewall of receptacle 77. In this initial position, dogs 85 will not transmit any downward weight. When engaging an upward facing shoulder, such as the rim of upper polished bore receptacle 77, dogs 85 will transmit a downward force. Packer setting tool 83 may have a clutch mechanism 87 of a type conventionally utilized for setting tools for liner top packers. Clutch mechanism 87 transmits rotation when weight is imposed on it. Packer setting tool 83 has a left-hand threaded connector 89 on its lower end. Threaded connector 89 will be secured to left-hand threads 78 (FIG. 2A) of the inner tubular body of liner top packer 67 while being assembled at the surface. The engagement of threaded connector 89 with threads 78 connects packer and cementing assembly 35 of FIGS. 2A-2C to running tool assembly 79 of FIGS. 3A and 3B.

Running tool assembly 79 includes a stinger 91 that extends downward from threaded connector 89. Stinger 91 is a tubular member that extends through valve assembly 43 and holds flapper elements 45 and 47 in the open position. Seals 63 (FIG. 5) in body 51 seal against stinger 91. Alternately, seals 63 could be located on stinger 91.

Stinger 91 has a cementing retainer or plug 93 releasably connected to its lower end. In this embodiment, cement retainer 93 is a latching type. As shown in FIG. 3B, cementing retainer 93 has an inner body 95 that may be rigid and formed of a drillable material. An axial passage 96 extends through inner body 95 for the passage of fluid. An outer sleeve 97 is formed of elastomeric material and has circumferentially extending ribs 99. Ribs 99 are adapted to form a seal in liner string 13. Cement retainer 93 has an adapter 101 on its upper end that releasably secures cement retainer 93 to the lower end of stinger 91 with shear pins. Adapter 101 has an internal seat 103 that is adapted to receive a sealing object pumped down, such as a dart 107 (FIG. 4D). Dart 107 is a conventional pump-down member that has seals and once in sealing engagement with adapter 101, the combination will form a seal in liner string 13. In this embodiment, a latch 105 extends around body 95 for engaging profile 17 (FIG. 1C). Alternatively, cementing retainer 93 could be a non-latching type.

In operation, the well will be drilled, preferably utilizing liner string 13 as the drill string. Once at total depth, liner hanger 31 (FIG. 1A) will be set in casing string 11 to support the weight of liner string 13. Then the operator retrieves liner running tool 27, drill pipe sections 26, 28 and bottom hole assembly 19 (FIG. 1C).

The operator then assembles running tool assembly 79 of FIGS. 3A and 3B in packer and cementing assembly 35 of FIGS. 2A-2C. When doing so, in this example, the operator will secure threaded connector 89 to threads 78 by left-hand rotation. Stinger 91 will pass through valve assembly 43, pushing and retaining flappers 45, 47 in the open position. Seals 63 (FIG. 5) seal around stinger 91. Tieback seal nipple 37 will be spaced such that when lowered into casing string 11, it will be substantially located within lower polished bore receptacle 29. Cement retainer 93 (FIG. 3B) will be in sealing engagement with tieback seal nipple 37. Dart 107 will not be in position at this time. The operator secures adapter 81 to a work string, such as drill pipe 26 (FIG. 4A), and lowers the entire assembly.

Figure 4B:
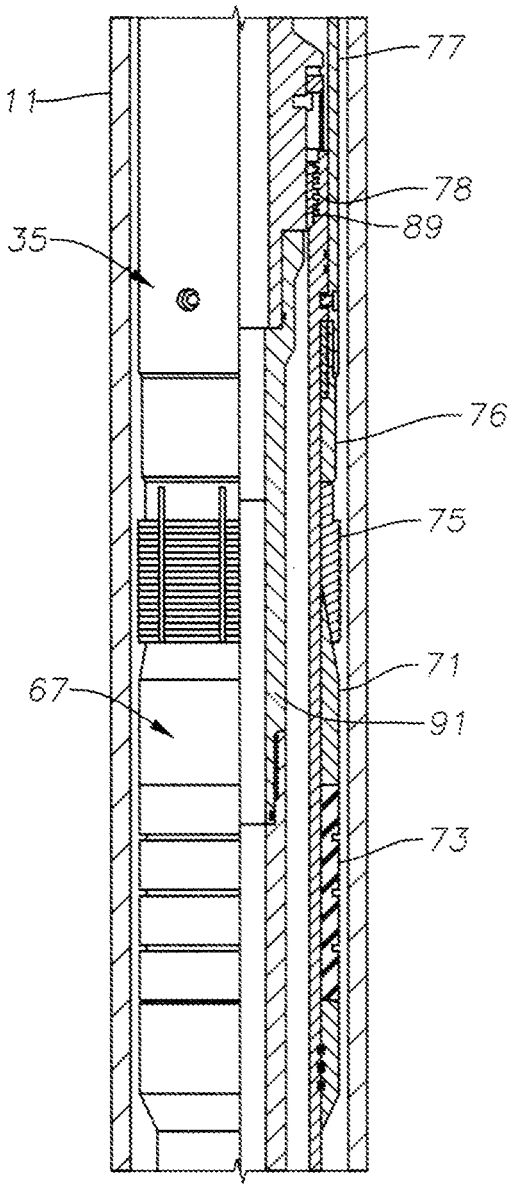
Figure 4C:
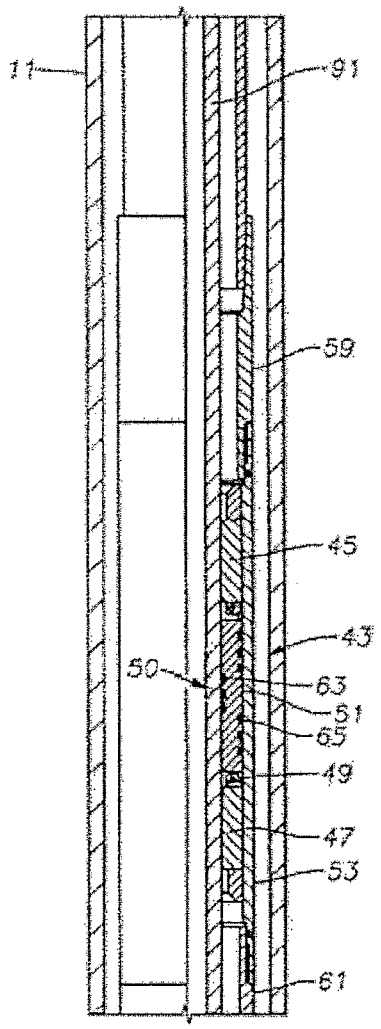
Figure 4D:
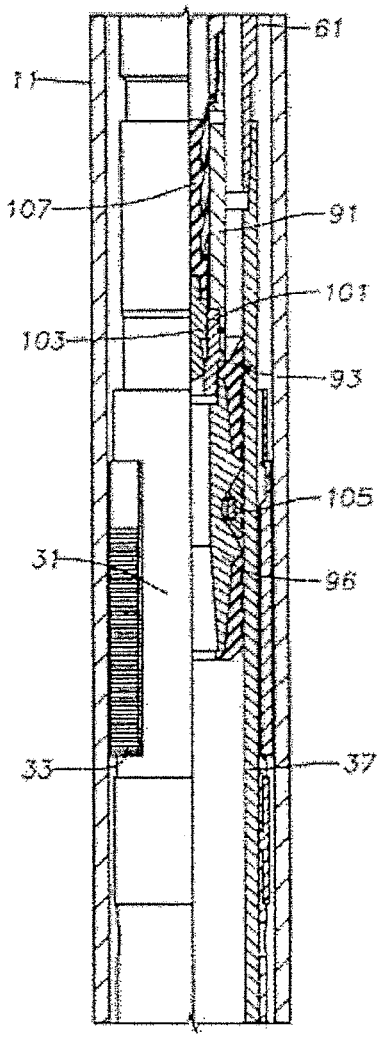
Figure 4E:
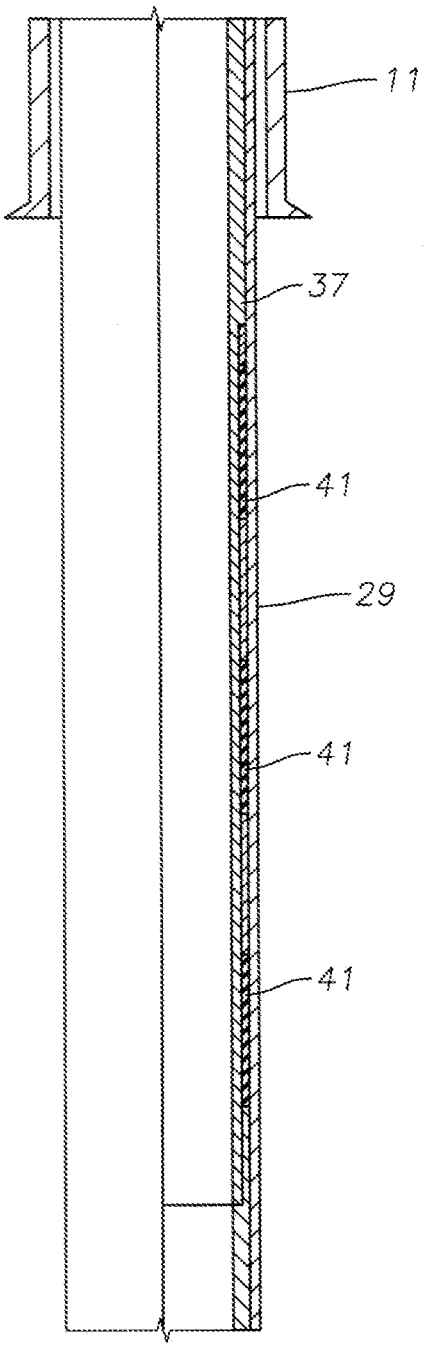
Figure 4F:
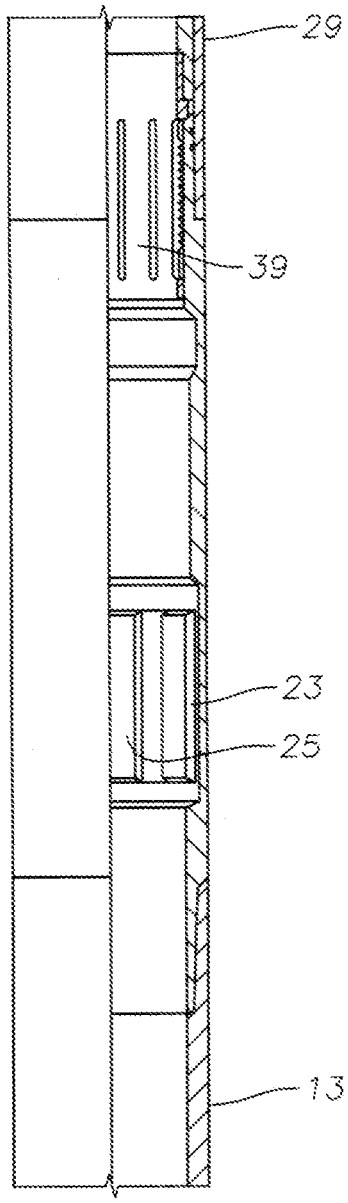

Referring to FIG. 4F, latch 39 on the lower end of tieback seal nipple 37 will enter lower polished bore receptacle 29 and latch into an annular grooved profile formed in the upper end of torque sub 23. As shown in FIG. 4D, cement retainer 93 will be located within liner hanger 31, and valve assembly 43 will be above, as shown in FIG. 4C. Liner top packer 67 will be located within casing string 11 above liner hanger 31 as shown in FIGS. 4B-4D.

The operator at that point preferably releases the engagement of running tool assembly 79 (FIG. 4D) from packer and cementing assembly 35 (FIG. 4B). In this embodiment, the operator disengages by rotating drill pipe 26 to the right, which will unscrew threaded connector 89 from internal threads 78 (FIG. 4B). Once released, the operator will pull running tool assembly 79 upward a short distance with drill pipe 26. This will cause the running tool assembly 79 to move upward relative to the packer and cementing assembly 35, indicating to the operator that running tool assembly 79 is released from packer and cementing assembly 35. The operator will then set back down without setting packer 67.

The operator then is free to pump cement down drill pipe 26 and the assembly shown in FIGS. 4A-4F. The cement will flow through cement retainer 93 (FIG. 4D), the torque sub 23 (FIG. 4F) and out the bottom of liner string 13. When the desired quantity of cement has been dispensed, the operator then drops dart 107 (FIG. 4D) down drill pipe 26. Dart 107 lands in sealing engagement with adapter 101 of cement retainer 93. Applying fluid pressure at the surface will cause the shear pin between adapter 101 and stinger 91 to release. Cement retainer 93 and dart 107 move down in unison into engagement with profile 17 (FIG. 1C). Once in engagement, cement retainer 93 and dart 107 form a seal in liner string 13 and are prevented from moving upward by the latching engagement. The cement in the annulus surrounding liner string 13 will be prevented from flowing back up within liner string 13 by cement retainer 93 and dart 107.

The operator will then set liner top packer 67 (FIG. 4B) by first pulling upward a distance sufficient for dogs 85 (FIG. 4A) to move above the upper end of upper polished bore receptacle 77. Dogs 85 will then spring outward past the outer diameter of upper polished bore receptacle 77. The amount of this upward movement is not enough to cause stinger 91 to move above valve assembly 43 (FIG. 4C), thus flappers 45, 47 remain open. The operator then lowers drill string 26 and running tool assembly 79 relative to packer and cementing assembly 35. Dogs 85 will contact the upper end of upper polished bore receptacle 77. The operator slacks off weight, which transmits through upper polished bore receptacle 77 to setting sleeve 76. Setting sleeve 76 will move downward relative to packer body 69, which causes liner top packer 67 to set. Its slips 75 will grip the inner diameter of casing 11. Packer elements 73 will seal against the inner diameter of casing 11.

The operator then will pull drill string 26 upward again, but a distance sufficient to place the lower end of stinger 91 above valve assembly 43. This upward movement causes stinger 91, which previously was holding flappers 45 and 47 (FIG. 4C) in the open position, to move above flappers 45 and 47. Flappers 45 and 47 will then spring to the closed position shown by the dotted lines in FIG. 5. This closed position prevents any upward flow of fluid in the event of cement in the annulus leaking past cement retainer 93 (FIG. 4D). The closure of flappers 45, 47 also prevents any downward flow of fluid below valve assembly 43. The barrier created will allow the operator to circulate a cleaning fluid, such as water, downward and out the lower end of stinger 91 (FIG. 4D). The cleaning fluid circulates back up the annulus surrounding drill pipe 26. Alternately, the operator could circulate the cleaning fluid down the annulus in casing 11 surrounding drill pipe 26 and back up stinger 91. This fluid flow will clean liner top packer 67 and upper polished bore receptacle 77 of cement and debris. If cleaning is not required, valve element 43 could have a single flapper valve element, rather than two. The single flapper valve element would block upward flowing fluid in case cement retainer 93 leaks, but would not block downward flowing fluid.

After cleaning, the operator is free to pull up running tool assembly 79, except for cement retainer 93, which remains latched at the lower end of liner sting 13. Once running tool assembly 79 has been retrieved, and when the operator wishes to complete the well, he will lower a string with a drill bit into the casing 11. The drill bit is employed to drill through the valve assembly 43, which is made of easily drillable components. This disintegration of valve assembly 43 thus opens the cemented liner string 13 down to cement retainer 93 (FIG. 3B). If desired, the operator may wish to drill out the cement retainer 93, which may also be formed of drillable materials. The operator then may complete the well by in a conventional manner, such as by running tubing and perforating.

While only one embodiment has been shown, it should be apparent to those skilled in the art that various changes and modifications may be made.

The invention claimed is:

1. A well tool apparatus comprising:

a tubular housing having an axis;

a pair of valve seats mounted within the housing in axial alignment with each other;

a pair of flapper valve elements, each secured by a hinge to one of the seats for pivotal movement between open and closed positions, each of the flapper valves being biased to the closed position in contact with one of the seats;

wherein one of the valve elements pivots in a first direction when moving from the closed to the open position;

the other of the valve elements pivots in a second direction when moving from the closed position, such that when both are in the closed position, fluid flow through the housing is prevented in both directions;

a tieback assembly for sealing and latching insertion into an upper portion of a liner string, wherein the housing comprises a portion of the tieback assembly;

a running tool assembly in releasable engagement with the tieback assembly for running the tieback assembly; and a tubular stinger extending downward from and forming a part of the running tool assembly, the stinger extending through both of the seats, thereby holding the valve elements in the open position until the running tool assembly is lifted relative to the tieback assembly.

2. The apparatus according to claim 1, further comprising:

an annular seal interface located axially between the valve elements for sealingly engaging a tubular stinger inserted through the seats while the valve elements are in the open position.

3. The apparatus according to claim 1, further comprising:

a tubular body having an outer diameter sealed to an inner diameter of the housing; and wherein one of the seats is located on one end portion of the body and the other of the seats is located on another end portion of the body.

4. The apparatus according to claim 3, further comprising:

an annular seal interface located in a bore of the body axially between the seats.

5. The apparatus according to claim 1, wherein:

an upper one of the valve elements pivots upward to the open position; and a lower one of the valve elements pivots downward to the open position.

6. The apparatus according to claim 1, wherein:

the hinges are located on a same side of the housing.

* * * * *